United States Patent [19]

Latash et al.

[11] 4,202,401

[45] May 13, 1980

[54] APPARATUS FOR ELECTROSLAG CASTING OF HEAVY INGOTS

[76] Inventors: Jury V. Latash, ulitsa Artema, 55, kv. 23; Alexei E. Voronin, ulitsa Prazhskaya, 3, kv. 426; Vladimir A. Nikolaev, ulitsa Vernadskogo, 61, kv. 75, all of Kiev; Boris B. Pelts, ulitsa Lesnaya, 63/43, kv. 57, Moscow; Lev A. Volokhonsky, ulitsa Mostnaya, 50-a, kv. 7, Moscow; Vladimir D. Artemiev, Leningradsky prospekt, 14, kv. 78, Moscow; Mikhail I. Vlasov, prospekt Mira, 124, korpus 10, kv. 277, Moscow; Alexandr I. Chernyak, ulitsa Verkhnyaya Khokhlovka, 39/47, kv. 53, Moscow; Alexandr A. Nikulin, ulitsa Znamenskaya, 35, kv. 112, Moscow; Vladimir S. Dub, ulitsa Festivalnaya, 14, korpus 3, kv. 372, Moscow; Yakov M. Vasiliev, ulitsa admirala Makarova, 14, kv. 44, Moscow; Iosif N. Stul, Sevastopolsky prospekt, 81, kv. 5, Moscow; Vitaly P. Mukha, ulitsa 1 Mekhanicheskaya, 7, kv. 22, Novosibirsk; Gennady I. Orlov; Kim M. Khasin, both of ulitsa Bljukhera, 7, kv., Novosibirsk; Jury A. Naryshkin, ulitsa Bljukhera, 7, kv. 53, Novosibirsk; Valentin I Belsky, ulitsa Zorge, 70, kv. 6, Norosibirski; Illya L. Veligura, ulitsa B. Khmelnitskogo 15, kv. 21, Kramatorak; Vladimir E. Bogdashich, ulitsa Shkidinova 55, kv. 34; Vladimir A. Lisitsin, ulitsa Shkolnaya 3, kv. 44; Alexandr V. Mischenko, ulitsa Kurchenko 15, kv. 9; Jury A. Kovalenko, ulitsa Parkovaya 27, kv. 38, all of Kramatorsk; Vladimir V. Balin, ulitsa Krasny Kayanets 9, korpus 2, kv. 136, Igor A. Svitenko, teply stan 5 mikroraion korpus 61, kv. 149, both of Moscow; Vladimir J. Antonov, ulitsa Petukhova 26, kv. 47, Novosibirsk; Volemir D. Smolyarenko, kutuyovsky prospekt 19, kv. 136, Moscow, all of U.S.S.R.

[21] Appl. No.: 880,062

[22] Filed: Feb. 22, 1978

[51] Int. Cl.[2] ..... B22D 27/02

[52] U.S. Cl. ..... 164/252; 164/259

[58] Field of Search ..... 164/50, 51, 52, 250, 251, 252, 66; 13/9ES; 75/10c, 10r

[56] References Cited

U.S. PATENT DOCUMENTS

| | | | |
|---|---|---|---|
| 2,191,477 | 2/1940 | Hopkins | 164/52 |
| 2,191,478 | 2/1940 | Hopkins | 164/252 |
| 2,976,587 | 3/1961 | Daussan | 164/133 |
| 3,234,608 | 2/1966 | Peras | 164/52 |

FOREIGN PATENT DOCUMENTS

| | | | |
|---|---|---|---|
| 1369772 | 10/1974 | United Kingdom | 164/252 |
| 268607 | 4/1970 | U.S.S.R. | 164/251 |

*Primary Examiner*—Robert D. Baldwin

*Attorney, Agent, or Firm*—Fleit and Jacobson

[57] ABSTRACT

The apparatus comprises a cooled mould mounted on a bottom plate, a roof mounted on the mould, non-consumable electrodes connected to a power source and introduced into the melting chamber of the mould through sealed apertures in the roof, and a liquid metal pouring system incorporating a metal conduit with a funnel mounted in an aperture in the roof and an inclined chute positioned above the metal conduit funnel. The roof is provided with a gas exhaust pipe and with input funnels for feeding slag and alloying admixtures. The junction between the roof and the mould is sealed. The non-consumable electrodes are arranged around the circumference of the melting chamber for vertical movement, whereas the inclined chute is adapated to move in the horizontal plane. The enclosed melting chamber makes it possible to reduce heat losses and to maintain a controlled atmosphere within the mould.

9 Claims, 7 Drawing Figures

APPARATUS FOR ELECTROSLAG CASTING OF HEAVY INGOTS

BACKGROUND OF THE INVENTION (a) Field of the Invention

The invention relates to the art of electrometallurgy, and more specifically, to apparatus for producing heavy ingots by the electroslag casting, i.e. by casting through a layer of molten slag electrically heated by non-consumable electrodes. The apparatus is particularly suited for the portionwise electroslag casting of heavy (over 15 tons) steel ingots.

(b) Description of the Prior Art

The method of portionwise electroslag casting according to which liquid metal is poured portionwise into a mould has solved the problem of producing heavy ingots with minimum structural defects. However, it is extremely difficult to achieve the requisite chemical composition of ingots obtained from the equipment intended for practising said method because of lack of adequate means for protecting the metal from the oxidizing action of the ambient air. In addition, power consumption of such equipment must of necessity be rather high to compensate for great heat losses.

Known in the art is an apparatus for the electroslag casting of heavy ingots comprising a mould mounted on a bottom plate, a liquid metal pouring system in communication with the melting chamber defined by the cooled walls of the mould and by the bottom plate, and non-consumable electrodes arranged around the circumference of the melting chamber for vertical movement and electrically connected to a power source (e.g., see the prospectus of E. O. Paton Electric Welding Institute "Portsionnaya elektroshlakovaya otlivka slitkov", "Reklama" Publishing House, Kiev, 1976).

The melting chamber of said apparatus is open, which results in:

(a) high heat losses through radiation of the slag pool surface which in turn, is responsible for a higher power consumption to maintain the requisite heating temperature and for an increased wear of metal parts of the apparatus caused by overheating;

(b) oxidizing action of the air on liquid metal and possibility of contamination thereof by other gases, e.g. hydrogen;

(c) dangerous working conditions for operators caused by sputtering as the metal is poured into the mould and by liberation of harmful gases formed in the electroslag process.

SUMMARY OF THE INVENTION

An object of the present invention resides in the provision of an apparatus for the electroslag casting of heavy ingots which makes it possible to maintain a controlled atmosphere within the melting chamber and to reduce heat liberation into surrounding medium.

It is a more specialized object of the invention to provide an apparatus for the electroslag casting of heavy ingots comprising a sealed, enclosed melting chamber.

Another object of the invention is to provide an apparatus for the electroslag casting of heavy ingots which makes it possible to introduce non-consumable electrodes into the enclosed melting chamber without loss of sealing.

Still another object of the invention is to provide an apparatus for the electroslag casting of heavy ingots incorporating a liquid metal pouring system which ensures an optimum velocity of metal flow.

A further object of the present invention is to provide an apparatus for the electroslag casting of heavy ingots which makes it possible to minimize sputtering in portionwise pouring of liquid metal and thereby to eliminate indentation of the ingot caused by solidified sputter on the mould walls.

The invention resides in that an apparatus for the electroslag casting of heavy ingots comprising a mould mounted on a bottom plate, the cooled walls of the mould and the bottom plate defining a melting chamber which communicates with a liquid metal pouring system, and non-consumable electrodes arranged around the circumference of the melting chamber for vertical movement and electrically connected to a power source, according to the invention incorporates a roof mounted on the mould so as to close the melting chamber and comprising a gas exhaust pipe, input funnels for feeding slag and alloying admixtures, apertures for non-consumable electrodes and an opening formed along the symmetry axis of the mould. The liquid metal pouring system comprises a metal conduit incorporating a funnel mounted in said opening in the roof and an inclined chute mounted above the funnel of the metal conduit and adapted to be moved in the horizontal plane, the junctions between the roof and the mould and between the roof and the non-consumable electrodes being sealed off, while manifolds for blowing in neutral gases are positioned at the points where the metal conduit joins the roof and the inclined chute.

The melting chamber of the foregoing apparatus is completely sealed off from the surrounding medium. This makes it possible to substantially reduce heat losses by shielding the slag pool radiation, and as a result there is no overheating of the metal parts of the apparatus, and power consumption for heating liquid metal in the electroslag process may be materially cut down.

In addition, sealing off of the melting chamber excludes any possibility of metal oxidation by the air, as well as penetration of hydrogen and other gaseous impurities into the liquid metal. Removal of harmful gases from the melting chamber, insulation of the environment from sputtering and excessive liberation of heat provide safe working conditions for operators. As all the junction areas between the roof and other components of the apparatus are sealed, it is possible to maintain a controlled atmosphere within the mould. The input funnels in the roof and the liquid metal pouring system incorporating a metal conduit with the funnel and an inclined chute make it possible to charge the mould with all the required constituents without loss of the melting chamber sealing.

Junction between the roof and each non-consumable electrode may be pressurized by a gas seal. This seal comprises two electrically insulated annular disks loosely enveloping the appropriate non-consumable electrode and an annular manifold substantially coaxial with said disks for blowing a neutral gas into the clearances between the annular disks and the non-consumable electrode. The first of said annular disks is secured to the roof over the appropriate aperture, and the second one is mounted on the first for movement in the horizontal plane so as to provide for self-adjustment of the non-consumable electrode relative to the roof. The annular manifold for blowing a neutral gas into the clearances between the annular disks and non-consumable electrodes may be integral with one of the annular disks.

A seal of such construction makes it possible to pressurize the junctions between the roof and non-consumable electrodes, even though the latter may vary considerably from a regular geometrical form. This being the case, the clearance between the annular disks and non-consumable electrodes is of minimum size, which results in low consumption of the neutral gas being fed through the annular manifold.

To maintain an optimum speed of metal flow, it is advisable that the angle between the inclined chute and the axis of the metal conduit make up 45° to 87°.

For withdrawal of a solidified ingot from the mould, it is essential that the roof be operatively connected to a hoisting gear mounted on a stationary main frame which forms an external guard of the mould location zone, the bottom plate with the mould being mounted on a driving carriage to be moved in the horizontal plane into the ingot withdrawal position. Such arrangement of the apparatus makes it possible to carry out the electroslag process with the mould being stationary and to avoid the upsetting of the protective coating and the damage of the lateral surface, which is inevitable in case of relative motion between the ingot and the mould in the process of casting.

Hoppers for slag and alloying admixtures with the connection pipes introduced into the appropriate input funnels in the roof may be mounted on the stationary main frame to ensure charging the mould without upsetting tightness of the junctions thereof with the roof.

To reduce sputtering during the pouring of liquid metal into the mould cavity it is advisable that the lower end of the metal conduit be as close as possible to the level of liquid metal in the mould. The method of portionwise electroslag casting of ingots makes it possible to position in the roof opening a metal conduit of a suitable length prior to pouring every following portion of metal into the mould. For this purpose the liquid metal pouring system may be provided with metal conduit replacement means mounted on the stationary main frame above the metal conduit funnel. This enables a quick replacement of a metal conduit without discontinuing the electroslag process.

To enable the replacement, the metal conduit may be provided with eyes, and the metal conduit replacement means may incorporate a movable Y-shaped carriage mounted on vertical guides of the stationary main frame and engaging the eyes of the metal conduit.

The Y-shaped carriage of the metal conduit replacement means may be, in particular, suspended upon the rope of a power winch mounted on the upper platform of the stationary main frame. In this case the hoppers for slag and alloying admixtures should be mounted on a lateral platform of the stationary main frame for movement in the horizontal plane, and the connection pipes and input funnels of the roof should be inclined.

BRIEF DESCRIPTION OF THE DRAWINGS

Hereinafter the invention is explained by the description of embodiments thereof and the accompanying drawings wherein.

DETAILED DESCRIPTION OF THE INVENTION

Figure 1:
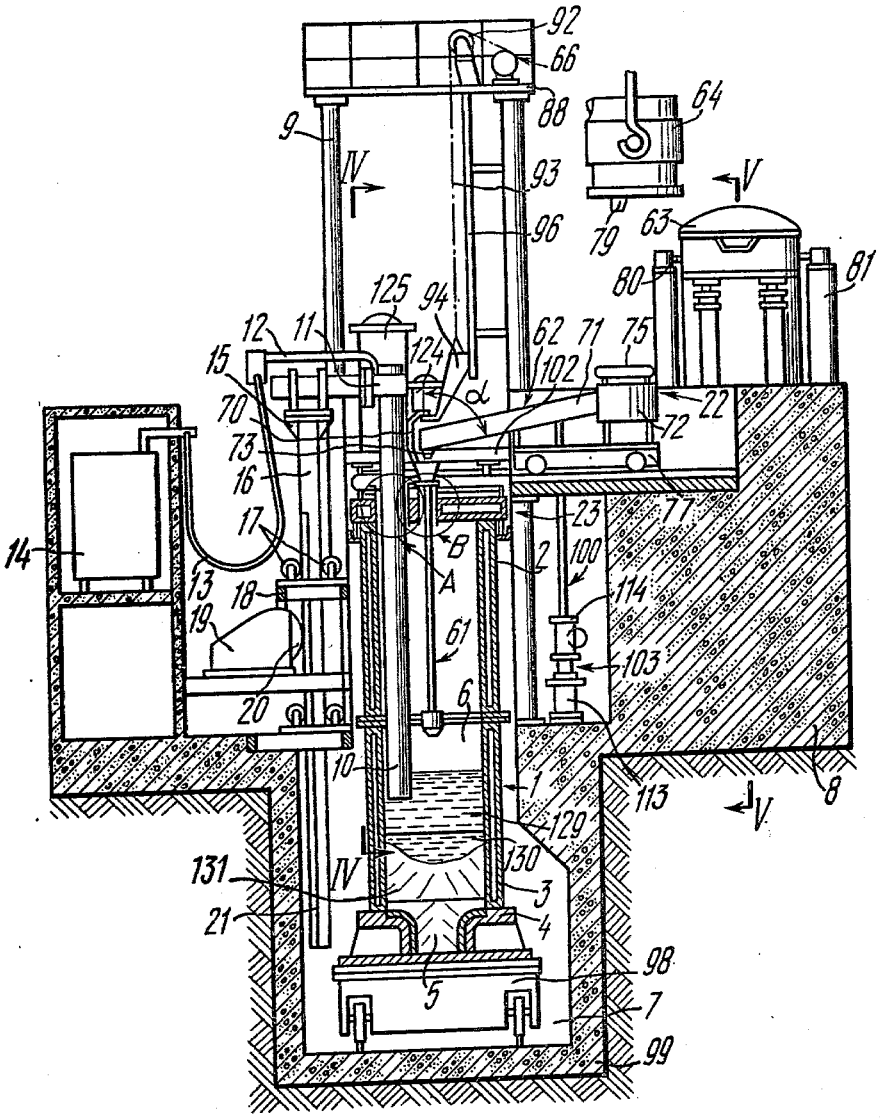
FIG. 1 is a diagrammatic general view of an apparatus for the electroslag casting of heavy ingots according to the invention (an apparatus for the portionwise electroslag casting is taken as an example)

The apparatus for the portionwise electroslag casting of heavy ingots comprises a mould 1 (FIG. 1) consisting of two superimposed sections 2 and 3 which may be of circular, box-like or any other shape. The walls of each section 2 and 3 are hollow to provide for coolant circulation (the coolant supply system is not shown). The lower section 3 is mounted on a bottom plate 4 whose surface is lined to afford heat insulation of the bottom portion of the ingot. The bottom plate 4 is provided with an opening 5 wherein a trunnion is formed by which the ingot is held during forging. The junctions between the sections 2 and 3 and between the section 3 and the bottom plate 4 are pressurized with seals (not shown).

The cavity of the mould 1 bounded at the bottom by the bottom plate 4 forms a melting chamber 6.

The apparatus may be provided with a plurality of moulds 1 of various sizes and with appropriate bottom plates 4, which accordingly makes it possible to cast ingots of various sizes.

The bottom plate 4 and the lower portion of the mould 1 are positioned in the recess of a substructure 8, a stationary main frame 9 being mounted, according to the invention, on the substructure 8 about the upper portion of the mould 1 and thereabove, which frame forms an external guard of the mould location zone and is intended to carry all stationary components of the apparatus.

Three non-consumable electrodes 10 are uniformly spaced about the circumference of the melting chamber 6 at the distance 100 mm to 300 mm from the mould walls, said electrodes being clamped in electrode heads 11 and electrically connected by a busbar 12 and by a flexible cable 13 to a power source 14 which is a three-phase transformer. The number of non-consumable electrodes may differ from that specified, but with a three-phase current supply it should be divisible by three.

The electrode heads 11 of non-consumable electrodes 10 are positioned in the electrode holders 15 secured to columns 16 which are mounted around the mould 1 for vertical movement in guide rollers 17 positioned on the support 18 of the stationary main frame 9. Each movable column 16 is operatively connected to an electrode drive mechanism 19. The electrode drive mechanism 19 comprises a motor, a brake (not shown) and a reducer incorporating a gear 20 which engages a rack 21 secured to the movable column 16.

Any other conventional mechanical or hydraulic drive may be used as the electrode drive mechanism 19.

The apparatus incorporates a liquid metal pouring system 22 which is in communication with the melting chamber 6 of the mould 1, hereinafter referred to in greater detail.

Figure 2:
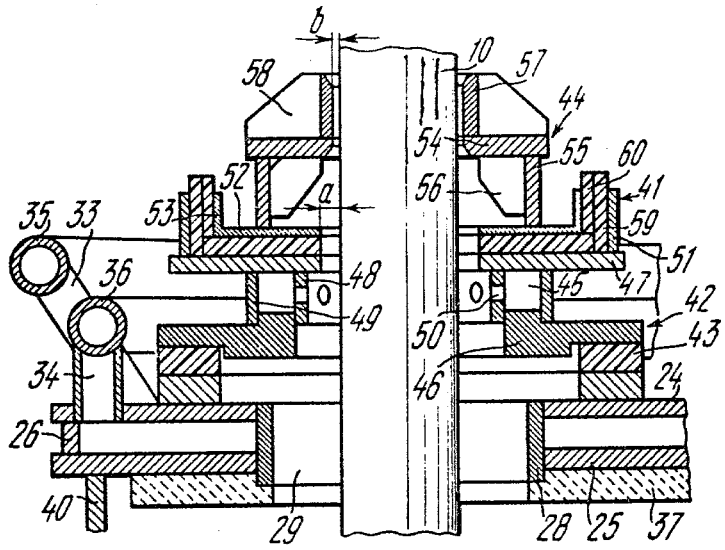
FIG. 2 is the unit "A" of the apparatus of the FIG. 1 showing the junction between the roof and a non-consumable electrode on an enlarged scale.

According to the invention the apparatus comprises a roof 23 mounted on the mould 1 so as to close the melting chamber 6. The roof 23 is cooled and comprises top and bottom metal plates 24 and 25, respectively, (FIG. 2) and a ring 26 interposed therebetween substantially around the circumference of the roof 23. The top and bottom metal plates 24 and 25 are formed with openings for mounting: a sleeve 27 (FIG. 3) positioned along the symmetry axis of the mould 1; sleeves 28 (FIG. 2) which serve as apertures 29 for non-consumable electrodes 10; a gas exhaust pipe 30 (FIG. 4) which communicates with a gas exhaust system (not shown); vertical connection pipes of funnels 31 and 32 for feeding slag and alloying admixtures, respectively. A closed cavity is thus formed between the metal plates 24 and 25 which is connected by pipes 33 and 34 (FIG. 2) to a circumferential tubular coolant supply manifold 35 and a similar coolant outlet manifold 36. The bottom metal plate 25 is lined with a refractory layer 37 on the side facing the melting chamber 6.

Figure 4:
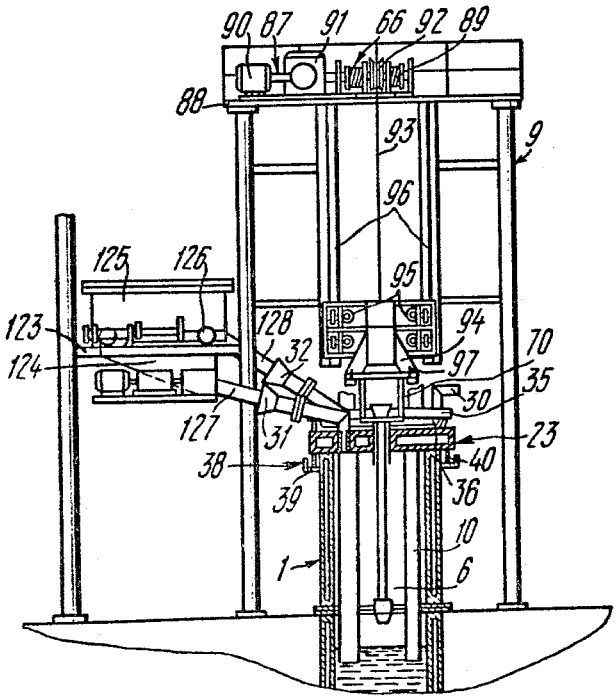
FIG. 4 is a section through the same apparatus along the line IV—IV in FIG. 1.

The junction between the roof 23 (FIG. 4) and the mould 1 is pressurized by a sand seal 38 which incorporates an ⊔-shaped trough 39, secured to the outside of the upper portion of the mould wall 1 and forming therewith a U-shaped cavity filled with sand, and a knife 40 (FIGS. 2, 4) which is a ferrule secured to the bottom metal plate 25 of the roof 23 so that it is inside the U-shaped cavity of the trough 39 (FIG. 4). The outside diameter of the ⊔-shaped trough 38 is the same for the moulds 1 of all sizes, so that one roof 23 may be used for casting ingots of various sizes.

The junctions between the roof 23 and non-consumable electrodes 10 (FIG. 2) are pressurized with gas seals 41. Each gas seal 41 incorporates a first annular disk 42 secured to the roof 23 through an insulating washer 43 in coaxial relation with the corresponding aperture 29 and loosely enveloping the electrode 10 with a clearance "a,38 a second annular disk 44 loosely enveloping the same non-consumable electrode 10 with a clearance "b" and mounted on the first annular disk 42 for horizontal movement within the limits of the clearance "a", and an annular manifold 45 for blowing a neutral gas into the clearances "a" and "b." In the embodiment under consideration the annular manifold 45 is formed integral with the first annular disk 42 which is a welded structure consisting of flanges 46 and 47 and of sleeves 48 and 49 interposed therebetween and forming a cavity which is in communication with a neutral gas supply system (not shown). The interior sleeve 48 is formed with annularly arranged openings for uniformly feeding a neutral gas into the clearances "a" and "b." The upper flange 47 is provided with an upwardly projecting annular shoulder 51.

An embodiment of the gas seal 41 is possible wherein the annular manifold 45 is formed integral with the second annular disk 44, or it is a separate component mounted in substantially coaxial relation with the first and the second annular disks 42 and 44.

The second annular disk 44 is also a welded structure and comprises a flange 52 which is disposed between sleeves 55 and 57 provided with corner plates 56 and 58, respectively. The second annular disk 44 is electrically insulated from the first annular disk 42 by a washer 59. To protect the washer 59 from damage when moving the annular disc 44 with respect to the annular disc 42, there is provided a flange on the washer 59, the flange having an upwardly extending annular shoulder 53. Between the annular shoulder 53 and the washer 59 there is provided an annular shoulder 60. The clearance "b" is so selected that the internal diameter of the sleeve 57 exceeds the maximum diameter of the non-consumable electrode 10 with allowance made for irregularities of its shape. The clearance "a">"b" allows for a departure of the position of each non-consumable electrode 10 from the symmetry axis of the mould 1. Mobility of the second annular disk 44 within the limits of the clearance "a" allows for self-adjustment of the non-consumable electrode 10 in the aperture 29 of the roof 23. As a result the gaps between the non-consumable electrode 10 and the members of the gas seal 41 are of minimum size, which makes it possible to minimize the consumption of the neutral gas entering the clearances of the junction through the annular manifold 45.

The liquid metal pouring system 22 (FIG. 1) incorporates a set of interchangeable metal conduits 61 of various lengths which are alternately positioned within the sleeve 27 (FIG. 3) of the roof 23 (FIG. 1), an inclined chute 62 mounted for movement in the horizontal plane above the metal conduit 61, heated liquid metal storage means in the form of conventional induction mixers 63 (FIGS. 1, 5) mounted on both sides of the inclined chute 62, a casting ladle 64 and an intermediate ladle 65 (FIG. 5), and also metal conduit replacement means 66 (FIG. 1).

Each metal conduit 61 (FIG. 3) consists of a funnel 67 with a flange 68 resting on the face plane of the sleeve 27, and of a pipe 69.

To facilitate its replacement the metal conduit 61 is provided with eyes 70 (FIGS. 1, 4).

Figure 3:
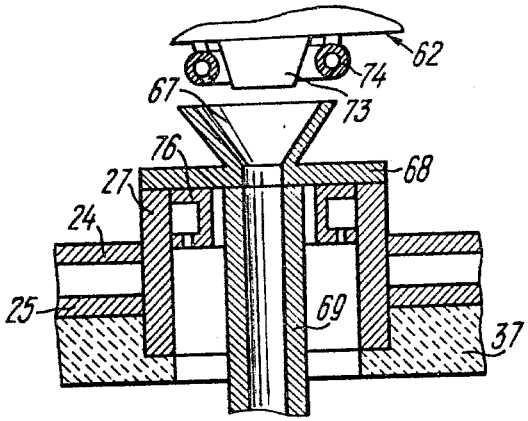
FIG. 3. is the unit "B" of the apparatus of the FIG. 1 showing the junction between the roof and metal conduit on an enlarged scale.

The inclined chute 62 (FIG. 1) is a lined enclosed tray 71 disposed above the funnel 67 of the metal conduit 61 and incorporating a well 72 at the inlet (FIGS. 1, 5) and a discharge pipe 73 at the outlet (FIGS. 1, 3). Mounted about the discharge pipe 73 (FIG. 3) is a manifold 74 for blowing a neutral gas into the space between the discharge pipe 73 and the funnel 67 formed as a ring-shaped tube. A similar manifold 75 (FIGS. 1, 5) is disposed adjacent the inlet of the well 72. One more manifold 76 (FIG. 3) is welded from the inside to the sleeve 27 of the roof 23. The manifold 76 serves to protect from leaks in the junction between the flange 68 of the metal conduit 61 and the face plane of the sleeve 27 and for blowing a neutral gas into the opening of the sleeve 27 during the replacement of the metal conduit 61. Thus when being poured into the mould 1 liquid metal is continuously protected from secondary oxidation and saturation with hydrogen by blowing a neutral gas over the open metal stream.

The angle "$\alpha$" between the inclined chute 62 (FIG. 1) and the axis of the metal conduit 61 makes up 45° to 87°. With "$\alpha$"<45° the speed of metal flow is too high, which results in turbulization thereof and causes sputtering and adhesion of metal to the non-consumable electrodes 10 and to the mould walls. With "$\alpha$">87° some of the liquid metal may be detained in the inclined chute 62 and cool down therein, which will result in narrowing of its cross-section and metal losses.

To allow for lifting the roof 23 and replacing the metal conduit 61, the inclined chute 62 is mounted on a driving carriage 77 which is movable in the horizontal plane.

Mounted above the well 72 of the inclined chute 62 is a stationary table 78 (FIG. 5) for the casting ladle 64 (FIG. 1) to be positioned thereon when the ingot is cast by pouring large portions of metal weighing 40–50 tons or for mounting the intermediate ladle 65 (FIG. 5) when the ingot is cast by pouring smaller portions of metal weighing 5–10 tons, the metal being taken from the induction mixers 63. Both ladles 64 and 65 are formed with bottom openings which are closed by plugs 79 (FIGS. 1, 5).

Figure 5:
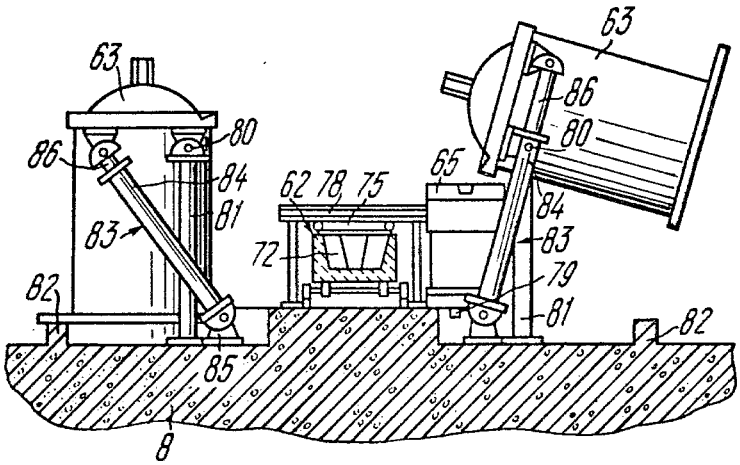
FIG. 5 is a section through the same apparatus along the line V—V in FIG. 1.

Each induction mixer 63 (FIG. 5) is mounted for rotation about a hinge pin 80 positioned on vertical struts 81 (FIGS. 1, 5). The bottom of the induction mixer 63 (FIG. 5) rests on the projection 82 of the substructure 8.

The induction mixers 63 are tilted by tilting devices 83, each device being formed as a fluid cylinder 84 hinged to a base 85 and incorporating a rod 86 hinged to the corresponding induction mixer 63.

The metal conduit replacement means 66 (FIGS. 1, 4) comprises a rope drive 87 (FIG. 4) mounted on the upper platform 88 of the stationary main frame 9 and incorporating a power winch 89 connected to an electric motor 90 through a reducer 91 and a pulley 92 (FIGS. 1, 4) over which a rope 93 is thrown. Suspended upon the rope 93 is a Y-shaped movable carriage 94, the rollers 95 (FIG. 4) of which are movably engaging vertical guides 96 (FIGS. 1, 4) of the stationary main frame 9. The Y-shaped movable carriage 94 incorporates two pins 97 (FIG. 4) adapted to engage the eyes 70 of the metal conduit 61.

Figure 6:
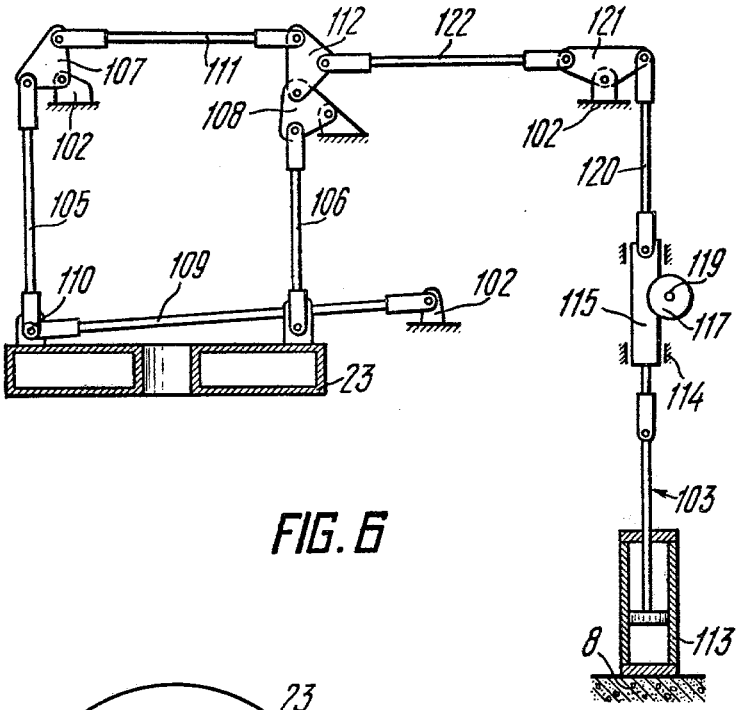
FIG. 6 is a functional diagram of the roof hoisting gear of the apparatus according to the invention.
Figure 7:
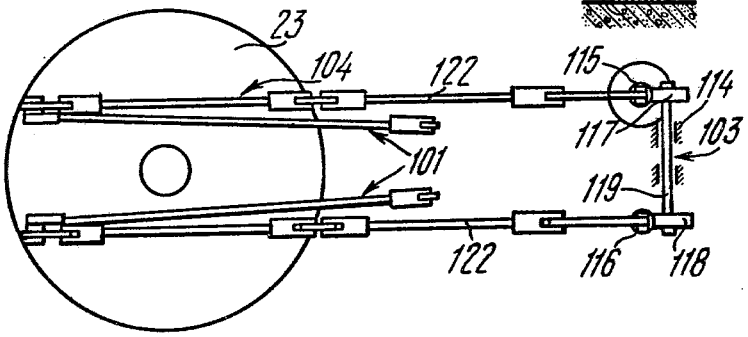
FIG. 7 is a top view of the functional diagram of the FIG. 6.

To allow for withdrawal of the ingot from the mould 1, the bottom plate 4 (FIG. 1) is mounted on a driving carriage 98 adapted to travel into the withdrawal position (not shown) along the horizontal floor 99 of the recess 7 in the substructure 6, and the roof 23 is operatively connected to a roof hoisting gear 100 (FIGS. 1, 6, 7).

The roof hoisting gear 100 comprises a plane-parallel lever system 101 by which the roof 23 is suspended from the framing 102 (FIGS. 1, 6) of the stationary main frame 9, and a drive 103 operatively connected to said lever system 101 (FIGS. 6, 7) and mounted on the substructure 8 (FIGS. 1, 6).

The plane-parallel lever system 101 is formed as two lever parallelograms 104 (FIG. 7) positioned in parallel. Each parallelogram 104 consists of a pair of lateral parallel levers 105 and 106 (FIG. 6) hinged to the roof 23 and coupled with the framing 102 by rockers 107 and 108, of a lower lever 109 having one end thereof coupled with the roof 23 by the same hinge pin 110 which couples the lateral lever 105 with the roof 23 and the other end hinged to the framing 102, and the upper lever 111 having one end thereof hinged to a rocker 107 and the other end hinged to the rocker 112, which, in turn, is hinged to the rocker 108.

The drive 103 comprises a fluid cylinder 113 (FIGS. 1, 6, 7) and a reducer 114 incorporating two parallel racks 115 and 116 (FIGS. 6, 7) and two gears 117 and 118 meshing therewith and mounted on a shaft 119 which is normal to both racks 115 and 116. The rack 115 is hinged to the rod of the fluid cylinder 113. The racks 115 and 116 are hinged to levers 120 (FIG. 6) coupled with the framing 102 by rockers 121 which in turn are coupled with the rockers 112 by levers 122.

A lateral platform 123 (FIG. 4) of the stationary main frame 9 carries a slag hopper 124 and hopper 125 for alloying admixtures mounted on a common carriage 126 movable in the horizontal plane. The hoppers 124 and 125 incorporate drive screw conveyers and stirring means (not shown) for positively feeding the contents thereof into the melting chamber 6 of the mould 1. The hopper 124 is provided with an inclined connection pipe 127 which is introduced during charging into the funnel 31 of the roof 23, and the hopper 125 is provided with a similar connection pipe 128 to be introduced into the funnel 32. The hoppers 124 and 125 thus form in conjunction with the funnels 31 and 32 of the roof 23 a sealed off system for feeding slag and alloying admixtures into the melting chamber 6 of the mould 1.

The apparatus operates as follows.

Prior to melting, the driving carriage 98 (FIG. 1) is in the withdrawal position, the inclined chute 62 is beyond the mould location zone (in FIG. 1—in the extreme right-hand position), the roof 23 is suspended on the framing 102 of the stationary main frame 9 and is kept in the uppermost position by the drive 103 on the roof hoisting gear 100, the movable columns 16 with the electrode holders 15 are transferred into the uppermost position by the electrode drive mechanisms 19, and the movable Y-shaped carriage 94 of the metal conduit replacement means 66 is also held in the uppermost position by the rope 93.

A metal starter bar is placed on the bottom plate 4 and covered with igniting charge and shavings, whereupon the mould 1 of the requisite size is mounted on the bottom plate 4 by a shop crane (not shown). The trough 39 (FIG. 4) is filled with sand. The bottom plate 4 (FIG. 1) with the mould 1 is moved into the casting position by the driving carriage 98, whereupon the drive 103 of the roof hoisting gear 100 is switched on, and the plane-parallel lever system 101 lowers the roof 23 onto the top face plane of the mould 1 so that the knife 40 (FIGS. 2, 4) is immersed into the sand filling the cavity of the trough 39 (FIG. 4).

The shop crane delivers non-consumable electrodes 10 (FIG. 1) to the electrode heads 11, and they are secured therein by a spring-operated lever clamp (not shown). The electrode drive mechanisms 19 lower all the three movable columns 16 with the electrode holders 15 secured thereto. As this takes place, each non-consumable electrode 10, going through the gas seal 41 (FIG. 2) in the roof 23, displaces the second annular disk 44 relative to the first annular disk 41 by the value corresponding to the departure thereof from the rated position relative to the mould symmetry axis (FIG. 1). The non-consumable electrodes 10 are lowered within the melting chamber 6 of the mould 1 until they contact the igniting charge and shavings.

The coolant supply system is switched on which is in communication with the wall cavities of the sections 2 and 3 of the mould 1 and with the tubular coolant supply and coolant outlet manifolds 35 and 36 (FIG. 2), and the gas exhaust system is switched on which is in communication with the gas exhaust pipe 30 (FIG. 4) and is intended to remove harmful gases from the melting chamber 6 of the mould 1.

To shorten the length of the metal jet and thereby to reduce the sputtering, the longest metal conduit 61 is selected from the set of interchangeable metal conduits (FIG. 1) and delivered by the shop crane to the movable Y-shaped carriage 94 of the metal conduit replacement means 66. The pins 97 of the movable Y-shaped carriage 94 engage the eyes 70 (FIG. 4) of the metal conduit 61, whereupon the drive 87 is switched on. The metal conduit 61 is lowered into the melting chamber 6 of the mould 1 through the opening of the manifold 76 (FIG. 3) of the sleeve 27 in the roof 23.

The inclined chute 62 is moved by the driving carriage 77 (FIG. 1) into the position wherein the axis of its discharge pipe 73 (FIGS. 1, 3) coincides with the axis of the funnel 67 of the metal conduit 61. The shop crane charges the hopper 124 with slag (FIGS. 1, 4) and the hopper 125 with alloying admixtures, whereupon both hoppers are moved by the driving carriage 126 (FIG. 4) so that their connection pipes 127 and 128 ar introduced into the input funnels 31 and 32, respectively, in the roof 23. Slag and alloying admixtures are fed into the melting chamber 6 through the connection pipes 127 and 128 and the funnels 31 and 32 by means of screw conveyers and stirring means of the hoppers 124 and 125.

Thereafter the power source 14 (FIG. 1) is switched on which supplies current to the non-consumable electrodes 10. Solid slag which was charged into the mould 1 from the hopper 124 melts thus forming a slag pool 129.

Upon formation of the slag pool 129 the neutral gas (e.g. argon) feeding system is switched on which is in communication with the manifolds:

45 (FIG. 2) of the gas seals 41, 76-(FIG. 3) disposed about the tube 69 of the metal conduit, 74 surrounding the discharge pipe 73 of the inclined chute 62, 75 (FIGS. 1, 5) disposed above the well 72 of the inclined chute 62.

The above manifolds serve for blowing argon over the open areas of the metal jet and for filling leaks in the junctions between the roof 23 and the metal conduit 61 and between the roof 23 and the non-consumable electrodes 10 with argon in order to protect liquid metal from the action of the ambient air. Argon enters the melting chamber 6 of the mould 1 building up therein an excess pressure.

Thereafter the first portion of liquid metal, premelted, e.g., in an arc furnace, is poured. Depending on the size of the ingot being cast, the weight of every portion of liquid metal may be equal to that of the entire heat of the arc furnace, or it may amount to a part thereof. In the first case, the metal is poured directly from the casting ladle 64 which is positioned by the shop crane onto the table 78 (FIG. 5) above the well 72 of the inclined chute 62. In the second case, the liquid metal is poured by the use of the intermediate ladle 65 which is filled from one of the two induction mixers 63 as it is rotated about the hinge pin 80 upon switching on the fluid cylinder 84 of the appropriate tilting device 83. In this case the intermediate ladle 65 is positioned into the table 78 instead of the casting ladle 64. Thereupon the plug 79 of the appropriate ladle is removed, and the liquid metal pours into the well 72 of the inclined chute 62. The liquid metal flows into the funnel 67 (FIG. 3) through the tray 71 and the discharge pipe 73 of the inclined chute 62, and through the pipe 69 of the metal conduit 61 it enters the melting chamber 6 (FIG. 1) of the mould 1. As the mould 1 is filled with the liquid metal, the electrode drive mechanisms 19, governed by an automatic regulator (not shown), raise at the appropriate speed the movable columns 16 with the electrode holders 15 and nonconsumable electrodes 10. After the first portion of metal has been poured, it is held under the slag pool 129 to provide for directional crystallization of the ingot 130. This is accompanied by the electroslag heating of the pool surface to prevent the formation of a metal crust and the slag and metal build-up on the mould walls. The requisite geometry of the liquid metal pool 131 is maintained by the predetermined melting conditions.

Prior to pouring the following portion of metal the metal conduit 61 is replaced because of the raised liquid metal level in the mould 1. For this purpose the inclined chute 62 is removed from the casting position by the carriage 77. The rope drive 87 (FIG. 4) of the metal conduit replacement means 66 is switched on, and the rope 93 moves upwards along the vertical guides 96 of the stationary main frame 9 of the movable Y-shaped carriage 94 which engages the eyes 70 of the metal conduit 61. When the lower edge of the metal conduit 61 is above the roof 23, with the aid of the crane the metal conduit 61 is removed from the movable Y-shaped carriage 94 and replaced with another metal conduit 61 of a shorter length. At the moment of the replacement, argon coming from the manifold 70 (FIG. 3) fills the sleeve 27 insulating the melting chamber 6 from the ambient air. The new metal conduit 61 mounted in the movable Y-shaped carriage 94 (FIG. 1) is lowered by the metal conduit replacement means 66 into the sleeve 27 (FIG. 3) of the roof 23 (FIG. 1).

The inclined chute 62 is returned to the casting position by the driving carriage 77, and the following portion of metal is poured by means of either the casting ladle 64 or the intermediate ladle 65 (FIG. 5) which is filled from the other induction mixer 63.

The liquid metal is poured portionwise with time intervals until the ingot reaches the predetermined size. The number of the interchangeable metal conduits 61 depends upon the height of the mould 1 and upon the amount of liquid metal poured in one portion. The replacement of the metal conduits 61 carried out in the time interval prior to pouring the following portion of metal makes it possible to maintain an optimum height of the metal jet and thereby to avoid excessive sputtering which is detrimental to the ingot 130 being cast (FIG. 1).

As the ingot 130 is formed, slag-forming materials are added from the hopper 124. At the same time reducing agents and alloying admixtures are introduced into the slag pool 129 from the hopper 125. As the ingot is builtup, liquid metal is poured into the intermediate ladle 65 alternately from the induction mixers 63 (FIG. 5). The application of the induction mixers 63 makes the process of the portionwise casting of ingots more flexible, allows for considerable changes in the weight of portions poured all at once and in time intervals between pourings, which simplifies the procedure.

When the casting of the ingot 130 (FIG. 1) is completed and the contraction cavity is removed, and power source 14 is switched off and the non-consumable electrodes 10 are lifted by the electrode drive mechanisms 19.

The inclined chute 62 is moved beyond the mould location zone by the driving carriage 77, and the last of the metal conduits 61 is lifted above the roof by the metal conduit replacement means 66.

The carriage 126 (FIG. 4) rolls the hoppers 124 and 125 aside so that their connection pipes 127 and 128 disengage the input funnels 31 and 32.

Thereupon the fluid cylinder 113 (FIG. 6) of the roof hoisting gear 100 is switched on. As a result the rod of the fluid cylinder 113 goes down moving the rack 115 coupled therewith and the rack 116 (FIG. 7) coupled with the rack 115 through the gears 117 and 118 of the shaft 119. The levers 120 (FIG. 6) turn the rockers 121 which by the lever 122 turn the rockers 112. This movement is transformed by the levers 111 and the rockers 107 into the lifting of the lever 105, and by the rockers 108 into the lifting of the levers 106 of both lever parallelograms 104. As this takes place, the roof 23, moving axially upwards, is suspended in the raised position upon the plane-parallel lever system 101.

The driving carriage 98 (FIG. 1) moves the bottom plate 4 with the mould 1 and the ingot 130 into the withdrawal position.

The apparatus of the disclosed construction may be also used for the electroslag casting by pouring at once all the requisite amount of metal. In this case only one from the set of the interchangeable metal conduits 61 is used the shortest.

The construction of the apparatus for the electroslag casting of heavy ingots according to the invention makes it possible to maintain a controlled atmosphere within the melting chamber and to improve the quality of the ingot by reducing the hydrogen content thereof and by excluding any possibility of liquid metal oxidation by the ambient air.

The apparatus affords constructional simplicity, operating economy and safety.

While but one embodiment of the present invention has been disclosed hereinabove, other adaptations and modifications thereof may be made without departing from the scope of the following claims.

We claim:

1. An apparatus for the electroslag casting of heavy ingots comprising: a bottom plate; a mould mounted on said bottom plate and provided with cooled walls which define in conjunction with said bottom plate a melting chamber, the cooled walls extending substantially continuously to the top of the melting chamber; a roof removably mounted on said mould so as to close the melting chamber; means for sealing the junction between said roof and said mould; a gas exhaust pipe; input funnels for feeding slag and alloying admixtures, said roof having openings formed therein for sealingly receiving the gas exhaust pipe and the input funnels for feeding slag and alloying admixtures to the melting chamber; a liquid metal pouring system incorporating a metal conduit removably mounted in an opening in said roof along the symmetry axis of said mould and provided with a funnel disposed in the upper portion of said metal conduit; an inclined chute mounted above said funnel of said metal conduit for movement in the horizontal plane; non-consumable electrodes arranged in apertures of said roof around the circumference of the melting chamber for vertical movement; sealing means for sealing the junctions between said roof and said nonconsumable electrodes; a power source electrically connected to said non-consumable electrodes; first manifold means positioned in the region of the mounting of the metal conduit to the roof for blowing a neutral gas into the mounting region, and second manifold means surrounding a discharge end of said inclined chute for blowing a neutral gas into a region between the discharge end and the funnel.

2. An apparatus according to claim 1, wherein said sealing means comprises gas seals for sealing off said junctions between said roof and said non-consumable electrodes, each of said gas seals comprising a first annular disk secured to said roof over the appropriate aperture and loosely enveloping the appropriate non-consumable electrode; a second annular disk loosely enveloping the same non-consumable electrode and mounted on said first annular disk for movement in a horizontal plane so as to provide for self-adjustment of said non-consumable electrode relative to said roof; a manifold for blowing a neutral gas into the clearances between said first and second annular disks and the appropriate non-consumable electrode, which manifold is mounted in a substantially coaxial relation with said annular disks.

3. An apparatus according to claim 2, wherein said manifold for blowing a neutral gas into the clearances between said annular disks and the appropriate non-consumable electrode is integral with any of said first and second annular disks.

4. An apparatus according to claim 1, wherein the angle between said inclined chute and the axis of said metal conduit is between 45° and 87°.

5. An apparatus according to claim 1, comprising a stationary main frame which forms an external guard of a mould location zone and a hoisting gear mounted on said stationary main frame and operatively connected to said roof, said bottom plate being provided with a driving carriage to be moved together with said mould in the horizontal plane.

6. An apparatus according to claim 5, comprising slag and alloying admixtures hoppers mounted on said stationary main frame, each of said hoppers being provided with a connection pipe which is introduced into the appropriate input funnel in said roof.

7. An apparatus according to claim 5, wherein the liquid metal pouring system is provided with metal conduit replacement means mounted on said stationary main frame above said funnel of said metal conduit for replacing a longer metal conduit with a shorter metal conduit when the slag level in the mould reaches a predetermined level.

8. An apparatus according to claim 7, wherein said metal conduit is provided with eyes and said metal conduit replacement means comprises a movable Y-shaped carriage which engages said eyes of said metal conduit, said stationary main frame being provided with vertical guides for mounting said movable Y-shaped carriage.

9. An apparatus for the electroslag casting of heavy ingots comprising a bottom plate; a mould mounted on said bottom plate and provided with cooled walls which define in conjunction with said bottom plate a melting chamber; a roof removably mounted on said mould so as to close the melting chamber, the junction between said roof and said cooled walls of said mould being sealed; a gas exhaust pipe; inclined input funnels for feeding slag and alloying admixtures to the melting chamber, said roof having openings formed therein for sealingly receiving said exhaust pipe and said input funnels; a stationary main frame forming an external guard of a mould location zone; said stationary main frame comprises vertical guides positioned above said mould; a lateral platform positioned at the side of said mould; an upper platform positioned above said vertical guides; a roofing hoisting gear operatively connected to said roof and mounted on said stationary main frame; a liquid metal pouring system incorporating a metal conduit mounted within an opening in said roof along the symmetry axis of said mould; said metal conduit comprises a funnel positioned in the upper portion thereof; eyes positioned at the sides of said funnel; metal conduit replacement means comprising a power winch mounted on said upper platform of said stationary main frame, a rope secured to said winch, and a movable Y-shaped carriage suspended upon one end of said rope, said movable Y-shaped carriage being engageable with said eyes of said metal conduit and being mounted for movement along said vertical guides of said stationary main frame; an inclined chute mounted above said funnel of said metal conduit for movement in the horizontal plane; non-consumable electrodes arranged in apertures of said roof around the circumference of the melting chamber for vertical movement; means for sealing the junctions between said roof and said non-consumable electrodes; a power source electrically connected to said non-consumable electrodes, first manifold means positioned in the region of the mounting of the metal conduit to the roof for blowing a neutral gas into the mounting region, and second manifold means surrounding a discharge end of said inclined chute for blowing a neutral gas into a region between the discharge end and the funnel; slag and alloying admixtures hoppers mounted on said lateral platform of said stationary main frame for movement in the horizontal plane; said slag and allowing admixtures hoppers being provided with inclined connection pipes which are introduced into the appropriate inclined funnels of said roof.

* * * * *